United States Patent [19]

Murayama

[11] 4,451,928

[45] May 29, 1984

[54] MULTI-SPEAKER SYSTEM FOR USE IN AUTOMOBILES

[75] Inventor: Fumio Murayama, Yamagata, Japan

[73] Assignee: Pioneer Electronic Corporation, Tokyo, Japan

[21] Appl. No.: 421,190

[22] Filed: Sep. 22, 1982

[30] Foreign Application Priority Data

Sep. 22, 1981 [JP] Japan ..... 56-139798[U]

[51] Int. Cl.[3] ..... H04R 1/02

[52] U.S. Cl. ..... 381/86; 179/146 E; 179/115.5 PS

[58] Field of Search ..... 179/146 E, 115.5 PS; 381/86, 87; 181/144

[56] References Cited

U.S. PATENT DOCUMENTS 2,539,672 1/1951 Olson ..... 179/115.5 PS
4,178,473 12/1979 Vermeren ..... 381/86
4,182,429 1/1980 Senzaki ..... 179/115.5 PS
4,365,114 12/1982 Soma ..... 179/146 E

FOREIGN PATENT DOCUMENTS 2063618 6/1981 United Kingdom ..... 179/115.5 PS

*Primary Examiner*—Harold I. Pitts
*Assistant Examiner*—L. C. Schroeder
*Attorney, Agent, or Firm*—Sughrue, Mion, Zinn, Macpeak, and Seas

[57] ABSTRACT

A multi-speaker system for use in automobiles includes a woofer, tweeter, and midrange speaker with the tweeter and midrange speaker being mechanically and electrically detachable from the woofer by removing an upper grille thereof. An external lead wire entering the rear of the woofer is branched at a location centrally of the woofer cone into a connection for litz wires for the woofer and a flexible lead wire connection for the remaining speakers to prevent inadvertant contact between the lead wires and car frame members.

12 Claims, 5 Drawing Figures

MULTI-SPEAKER SYSTEM FOR USE IN AUTOMOBILES

BACKGROUND OF THE INVENTION

The present invention relates to a loudspeaker system for use in automobiles, and more particularly to a multi-speaker system for use in automobiles.

Speaker systems for use in cars have been improved upon in an effort to reproduce high-fidelity sounds within the auto compartment. Coaxial-type multi-speaker systems similar to those for home use have thus found wider use in cars. Although coaxial-type multi-speaker systems have excellent characteristics, they have proven unsatisfactory when installed in cars, as there are limitations on the positions in which they can be installed.

More specifically, most speaker systems for audio equipment designed for use in automobiles are mounted on or under a rear parcel tray or deck thereof, which is substantially horizontal, though ordinarily inclined slightly. When the speaker system is installed on the rear parcel tray, the central axis of the speaker system is not directed into the car compartment, but intersects the rear window glass. As far as low-frequency sound waves are concerned, such an installation is not disadvantageous in that the low-frequency sound has no sharp directivity and can reach passengers without undergoing much attenuation. However, since sounds of midrange and high frequencies are of sharp directivity and are directed to the rear window glass and the ceiling, the passengers listen to relatively attenuated sound waves as reflected back from the rear window glass and the ceiling. This obscures the position of the sound source as heard by the passengers and impairs sound separation in stereophonic reproduction.

Installation of the speaker unit on or under the rear parcel tray is highly advantageous, however, in that the trunk of the car can be utilized as the speaker enclosure so as to be able to produce sounds of low frequencies. Accordingly, it has been customary in most applications to mount the spaker system on the rear parcel tray.

To solve the foregoing problems, the present applicant has proposed a multi-speaker system for use in cars which includes a low-frequency loudspeaker A′ (FIG. 1) having a central axis extending perpendicularly to a rear parcel tray T, and a midrange and high-frequency loudspeaker B′ mounted on a holder C′ attached to a basket of the low-frequency loudspeaker A′ and having a central axis extending at an angle of about 30 degrees with respect to the central axis of the low-frequency loudspeaker A. The multi-speaker system thus constructed has a sound-pressure distribution pattern as shown in FIG. 2, in which high-frequency sounds are beamed centrally in a zone in which low-frequency sounds spread out. Consequently, a fixed sound image can be created with such a midrange speaker system design.

The low-frequency loudspeaker of the multi-speaker system includes a basket or frame having an integral tongue projecting radially outwardly thereof and a terminal plate fastened thereto. Lead wires extending from the voice coil are connected to input lead wires on such terminal plate. The lead wires from the voice coil are normally composed of litz wires having no insulating coating, and are jointed to the input lead wires by soldering, so that the junctions on the terminal plate are exposed. Accordingly, the litz wires tend to contact the basket of the low-frequency loudspeaker, and the litz wire and the junctions are apt to touch conductive iron or steel car frame members when the multi-speaker system is installed on the rear parcel tray or after the multi-speaker system has been fixed thereto. When this occurs, the lead wires are short-circuited resulting in damage to the speaker system itself or to an amplifier connected thereto.

Lead wires to the midrange and high-frequency loudspeakers are branched from the terminal plate or directly from the litz wires. Inasmuch as the branched lead wires to the midrange and high-frequency loudspeakers are positione closely the basket of the low-frequency loudspeaker, they are also liable to contact the loudspeaker basket or the frame members of the car. Furthermore, the lead wires to the high-frequency loudspeaker extend in the vicinity of the diaphragm of the low-frequency loudspeaker and hence are subject to the danger of touching the diaphragm as it vibrates in an increased stroke, attributing to the generation of the noise and the breakage of the lead wires.

SUMMARY OF THE INVENTION

With the foregoing problems in view, it is an object of the present invention to provide a multi-speaker system for use in cars which has feeder leads which are prevented from contacting a loudspeaker frame, car frame members, and the diaphragm of a low-frequency loudspeaker.

BRIEF DESCRIPTION OF THE DRAWINGS

The present invention will now be described in detail with reference to the drawings in which.

DETAILED DESCRIPTION OF THE PREFERRED EMBODIMENTS

Figure 1:
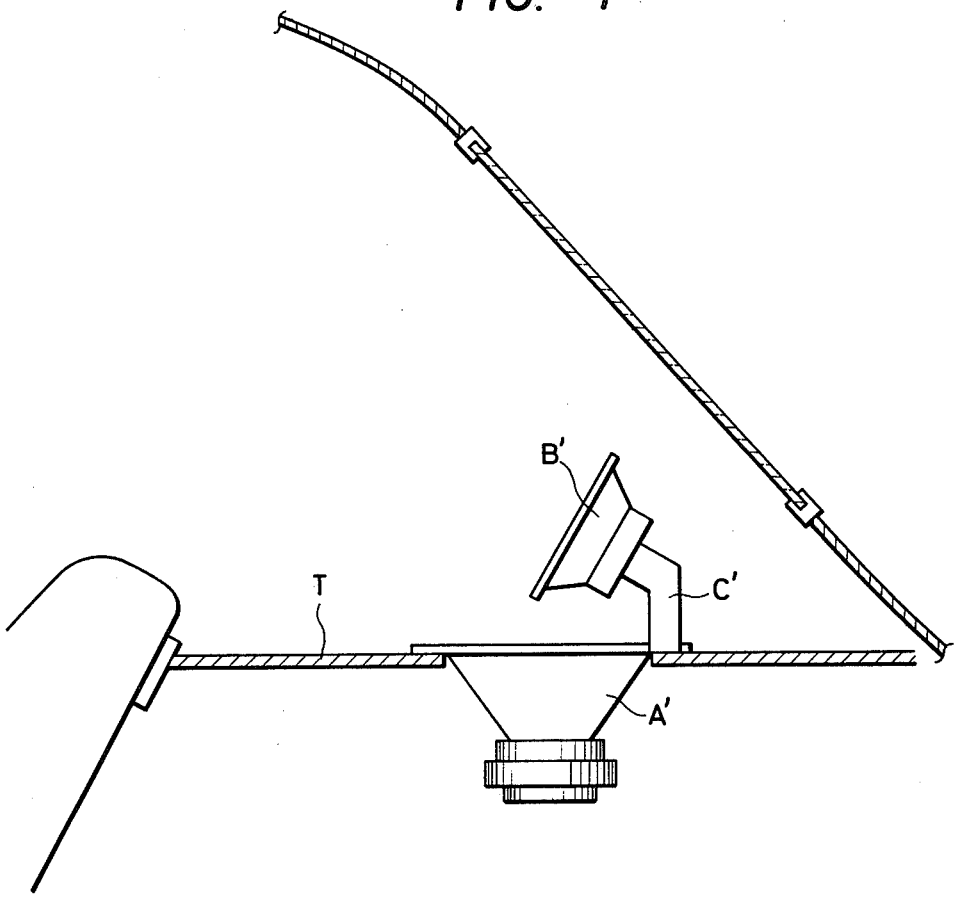
FIG. 1 is a schematic side elevational view of a conventional multi-speaker system mounted in a car.
Figure 2:
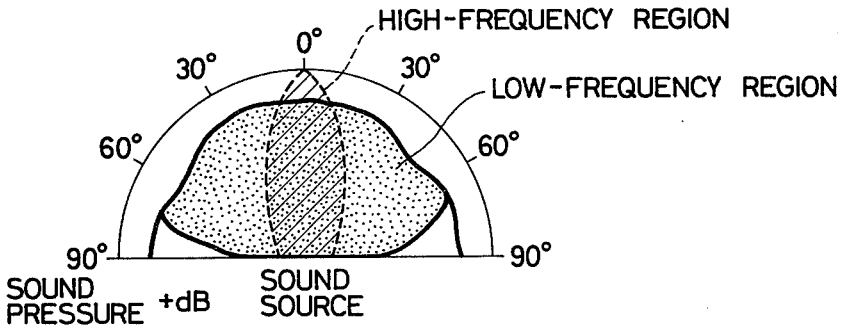
FIG. 2 is a diagram illustrative of the distribution of sound pressure developed by the multi-speaker system shown in FIG. 1.
Figure 3:
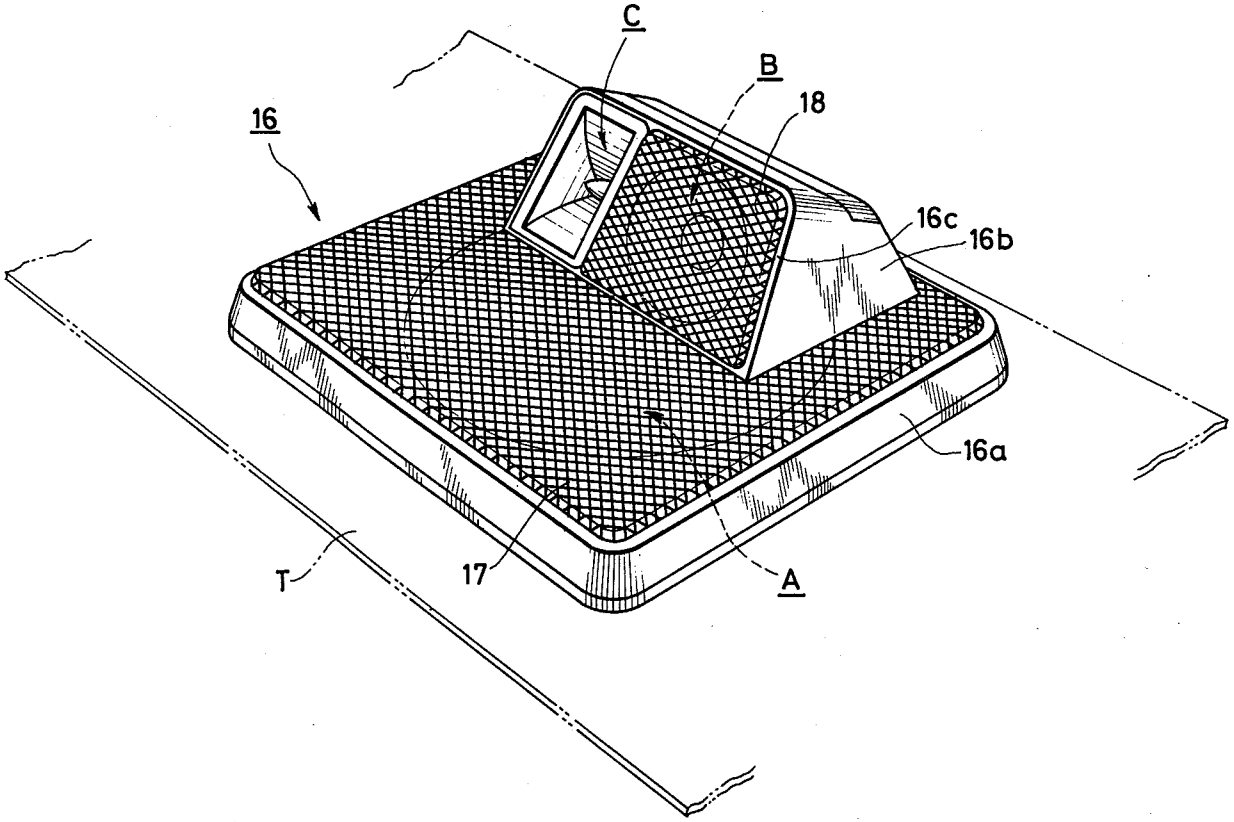
FIG. 3 is a perspective view of a multi-speaker system for use in a car, according to the present invention.
Figures 4, 5:
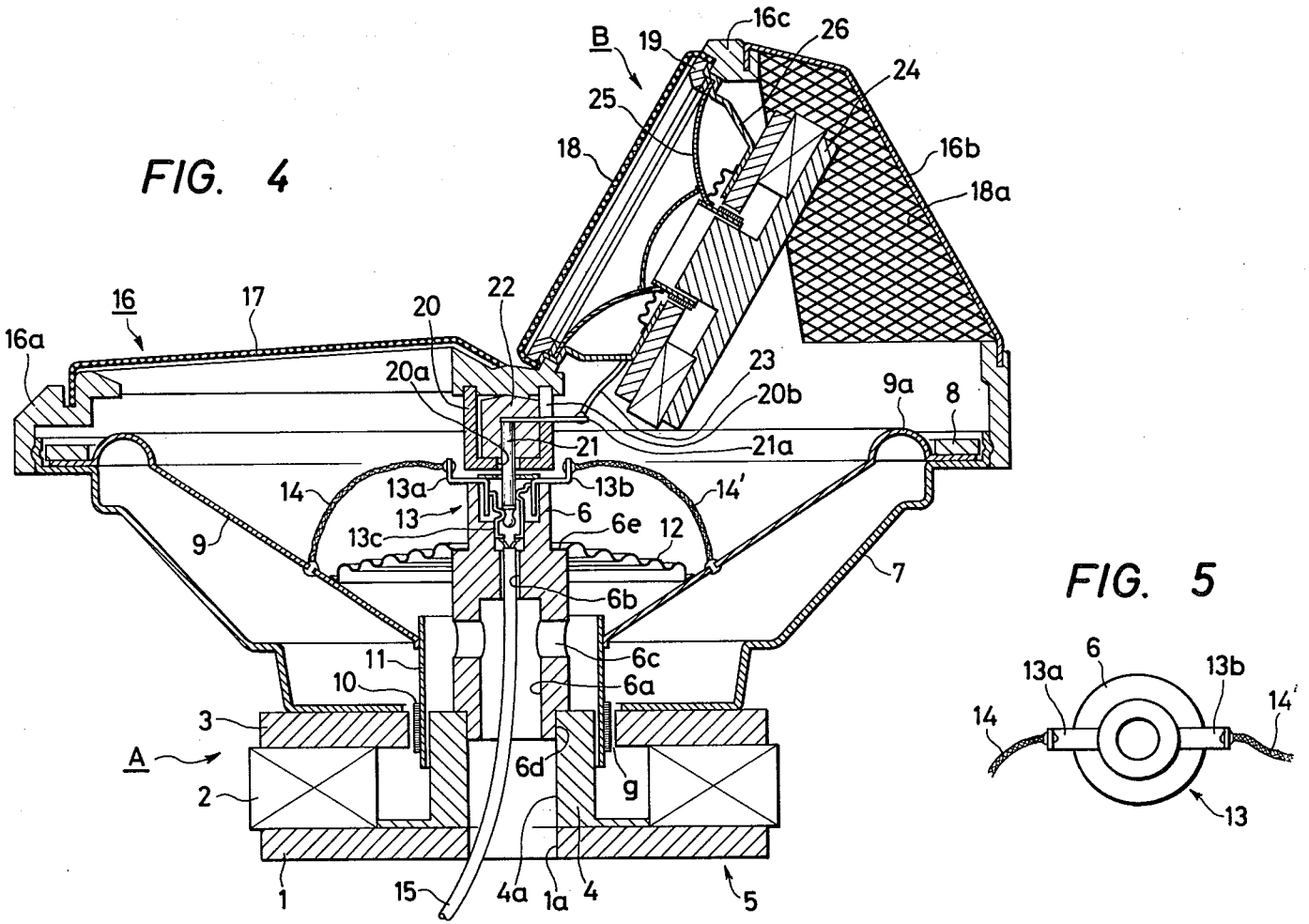
FIG. 4 is an enlarged cross-sectional view of the multi-speaker system shown in FIG. 3.
FIG. 5 is a plan view of a terminal holder of the multi-speaker system of FIG. 4.

As shown in FIGS. 3 and 4, a multi-speaker system according to an embodiment of the invention comprises a low-frequency loudspeaker or woofer A mounted on a rear parcel tray T of an automobile and having a central axis extending perpendicularly to the rear parcel tray T, a mid-range loudspeaker B having a central axis extending at an angle of about 30 degrees with respect to the central axis of the low-frequency loudspeaker, and high-frequency loud-speaker or tweeter C having a central axis extending parallel to the central axis of the midrange loudspeaker B.

The low-frequency loudspeaker A has a drive unit 5 composed of a bottom plate 1, a ring magnet 2, a top plate 3 and a central pole 4 which are assembled to provide an external path of magnetic energy, the top plate 3 and the center pole 4 jointly defining a magnetic gap g therebetween. The bottom plate 1 and the central pole 4 have central holes 1*a*, 4*a*, respectively. A cylindrical terminal holder 6 is mounted on the center pole 4 and extends upwardly (as shown in FIG. 4) from an upper end thereof in coaxial relation. The cylindrical terminal holder 6 has a distal end located substantially in the center of a conical space defined by a cone-shaped diaphragm 9, the cylindrical terminal holder 6 being made of an insulating non-magnetic material. The cylindrical terminal holder 6 has an axially large-diameter hole 6*a*, an axial smaller diameter hole 6*b* communicating therewith, and a lateral through hole 6*c* extending diametrically across the larger-diameter hole 6*a*. The lower end of the cylindrical terminal holder 6 has an annular step 6*d* fitted in the upper end of the center pole 4. Thus, the larger-diameter hole 6*a*, the smaller-diameter hole 6*b* and the holes 1*a*, 4*a* are coaxially held in communication with one another.

A frame or basket 7 is secured to the top plate 3 and has an outer peripheral edge on which is supported an outer edge 9*a* of the cone-shaped diaphragm 9 by a mounting gasket 8. The diaphragm 9 has a bobbin 11 fixed to an inner edge thereof and supporting a voice coil 10 wound around the bobbin 11. The voice coil 10 is centered in the magnetic gap g by a centering damper or spider 12 cemented to an upper step 6*e* of the terminal holder 6 and the diaphragm 9.

A terminal assembly 13 is mounted on the upper end of the terminal holder 6 above the smaller-diameter hole 6*b*. The terminal assembly 13 includes a pair of terminals 13*a*, 13*b* (FIG. 5) projecting radially outwardly from the upper end of the terminal holder 6, and a central jack 13*c* in which a plug can be fitted. A double-conductor input lead wire 15 extends through the holes 4*a*, 1*a* in the center pole 4 and the bottom plate 1, respectively, the larger-diameter hole 6*a* in the terminal holder 6 and the smaller-diameter hole 6*b*, and is connected to the jack 13*c*. A pair of litz wires 14, 14' which are connected to the voice coil 10 of the low-frequency loudspeaker A are connected at one end thereof to the terminals 13*a*, 13*b*, respectively. The litz wires 14, 14' extend radially across a substantially central portion of the space defined by the core-shaped diaphragm 9 and have their other or inner ends fixed to the diaphragm 9 at substantially the central portion between the outer and inner peripheral edges thereof, the fixed inner ends being coupled to lead wires extending from the voice coil 10 along the outer surface of the diaphragm 9.

A grill frame 16 of synthetic resin is detachably fitted over the upper open end of the basket 7 of the low-frequency loudspeaker A. More specifically, the basket 7 has a ridge extending along an outer peripheral surface thereof and the grille frame 16 has a groove extending along an inner peripheral surface thereof, the ridge on the basket 6 being snapped in the slot in the grille frame 16. The grille frame 16 includes an outer frame member 16*a* fitted over the basket 7 and a housing 16*b* projecting upwardly, at a position slightly to the rear of the geometer center of the grille frame 16. The grille frame 16 also includes a protective net 17 covering a flat opening around the housing 16*b*. The housing 16*b* has solid side walls, and front and rear faces covered with protective nets 18, 18*a*, respectively, the midrange loudspeaker B being disposed in the housing 16*b* behind the protective net 18.

The midrange and high-frequency loudspeakers B, C are accommodated in the front opening of the housing 16*b*. As best shown in FIG. 4, the midrange loudspeaker B includes a magnetic circuit 24 have an external magnetic energy path and a cone-shaped diaphragm 25 which is supported by a frame or basket 26 secured to a frame 16*c* defining a front opening, there being a grille 19 mounted on the basket 26 at its front face.

A box-shaped terminal cover 20 is fitted in a lower surface of the frame 16*c* centrally of the low-frequency loudspeaker A. The box-shaped terminal cover 20 has a bottom aperture 20*a* and contains an elastomeric body 22 such as of rubber. The elastomeric body 22 is molded around a plug 21 which is resiliently movably supported thereby for pivotable movement within an angular range determined by the clearnace between the plug 21 and the aperture 20*a*. The plug 21 has a distal lower end projecting downwardly through the bottom aperture 20*a* and an upper rear end connected to one end of a connector 21*a* within the elastomeric body 22. The other end of the connector 21*a* extends out of the terminal cover 20 through a recess 20*b* defined therein and is coupled to a lead wire 23. The lead wire 23 is connected to the voice coils of the midrange and high-frequency loudspeakers B, C and extends along a minimum path laterally from the frame 26 of the midrange loudspeaker B inclined within the housing 16*b*, as shown in FIG. 4.

The feeder leads of the multi-speaker system thus constructed therefore include the input lead wire 15 extending from the exterior through the holes 4*a*, 1*a* in the center pole 4 to a substantially central position in the conical space defined by the cone-shaped diaphragm 9, from which the litz wires 14, 14' are led to the front surface of the diaphragm 9 of the low-frequency loudspeaker A and the lead wire 23 is led to the midrange loudspeaker B which faces obliquely forward.

The lead wire 15, the terminals 13*a*, 13*b*, and the lead wire 23 are thus located centrally and upwardly in the conical space bounded by the cone-shaped diaphragm 9. This lead wire arrangement prevents the lead wires and terminals from being brought into contact with car frame members when the multi-speaker system is mounted on the rear parcel tray, or door or the like. Furthermore, there is no danger of the litz wire contacting the surroundings even when the diaphragm 9 of the low-frequency loudspeaker moves back and forth an increased length.

When the grille frame 16 is detached from the basket 7 of the low-frequency loudspeaker A, the latter and the midrange and high-frequency loudspeakers B, C are electrically and mechanically separated from each other. For attachment to the rear parcel tray T, the basket 7 of the low-frequency loudspeaker A as separated is first attached to the rear parcel tray T. Then, the grille frame 16 is fitted over the basket 7 with the plug 21 inserted into the jack 13*c*. Since the plug 21 is displaceable with the elastomeric body 22, the plug 21 can smoothly be inserted into the jack 13*c* even when they are slightly out of alignment with each other. With the plug 21 and the jack 13*c* being located centrally of the low-frequency loudspeaker A, the basket 7 and the grille frame 16 are freely positionable relative to one another in the circumferential direction around the plug 21 and the jack 13*c*, with the result that there will be greater room for the design of periphery shapes and dimensions of the basket 7 and the grille frame 16.

In the illustrated embodiment, the midrange and high-frequency loudspeakers B, C are accommodated in the housing 16 projecting upwardly at a position rearward of the geometric center of the grille frame 16 of the low-frequency loudspeaker A. When the speaker system is to be mounted on the rear parcel tray T, sufficient space may not be available in which to fit the grille frame 16 over the basket 7 from above, because the housing 16 will be obstructed by the inclined rear window. According to the present invention, the plug 21, which is pivotably supported by the elastometric body 22, can be inclined within the angular range defined by the opening 20*a*, so that the grille frame 16 can be brought into fitting engagement with the frame 7 obliquely from above without interfering with the rear window. Therefore, the multi-speaker system of the invention can be installed in position in a simple procedure.

In actual operation of the multi-speaker system thus mounted, the diaphragm 9 of the low-frequency loudspeaker A moves back and forth a large stroke to change the volume of air below the spider 12. Since air can be forced out of and introduced into the space below the spider 12 through the lateral hole 6*c*, the large-diameter hole 6*a* and the holes 1*a*, 4*a*, the diaphragm 9 can vibrate properly without being subjected to undue air pressure, and heat from the voice coil 10 can effectively be dissipated.

Resilient support of the plug 21 afforded by the elastometric body 22 molded therearound can take up vibration caused when the car is running, and hence reduce relative friction between the plug 21 and the jack 13*c* to thereby hold wear on the plug 21 and the jack 13*c* to a minimum.

According to the present invention, as described in detail, a multi-speaker system includes a low-frequency loudspeaker, midrange and high-frequency loudspeakers mounted on the low-frequency loudspeaker, the low-frequency loudspeaker having a magnetic circuit including a center pole having a through hole extending in the direction in which sound is radiated from the low-frequency loudspeaker, and an external lead wire extending through the through hole toward a distal end of the center pole and divided at the distal end into branches toward the low-frequency loudspeaker and the midrange and high-frequency loudspeakers.

With the above arrangement, the low-frequency loudspeaker has a frame or basket on which there are mounted no lead wire terminals and no litz wires, and lead wires to the midrange and high-frequency loudspeakers are not exposed to the exterior. Instead, the lead wires, terminals and litz wires are located substantially centrally within the space defined by the cone-shaped diaphragm of the low-frequency loudspeaker. This is no risk of such lead wires, terminals and the like touching car frame members during attachment of the speaker system, and hence of the speaker system and an amplifier connected therewith to be damaged. While the speaker system is energized, the lead wires are prevented from contacting the diaphragm of the low-frequency loudspeaker, with the result that the speaker system will not produce noise due to accidental contact with the lead wires, and the lead wires will be protected against breakage. The multi-speaker system can easily be installed, and can reproduce sounds of high quality.

What is claimed is:

1. A multi-speaker system, comprising; a low-frequency loudspeaker, midrange and/or high-frequency loudspeakers mounted on the low-frequency loudspeaker, the low-frequency loudspeaker having a magnetic circuit including a center pole having a through hole extending in a direction in which sound is radiated from the low-frequency loudspeaker, and an external input lead wire extending through said through hole toward a distal end of said center pole and divided at said distal end into branches toward said low-frequency loudspeaker and said midrange and/or high-frequency loudspeakers.

2. A multi-speaker system according to claim 1, wherein said low-frequency loudspeaker comprises a cone-type loudspeaker defining an inner space therein, said branches of said lead wire toward said low-frequency loudspeaker and said midrange and/or high-frequency loudspeakers extending to respective voice coils thereof and being disposed substantially within said inner space.

3. A multi-speaker system according to claims 1 or 2, including a grille detachably mounted on a basket of said low-frequency loudspeaker, said midrange and/or high-frequency loudspeakers being supported on said grille and having a terminal assembly to which said branch to said midrange and/or high-frequency loudspeakers is detachably attached, whereby said midrange and/or high-frequency loudspeakers may be mechanically and electrically detached from said low-frequency loudspeaker and said external input lead wire.

4. A multi-speaker system according to claim 3, wherein said terminal assembly comprises a plug, and a jack which can be fitted over the plug.

5. A multi-speaker system according to claim 4, wherein said plug is mounted on said grille and said jack is mounted on said center pole.

6. A multi-speaker system according to claim 4, wherein said plug is pivotably movable supported by an elastomeric body supported on said grille.

7. A multi-speaker system according to claim 6, including a box supported on said grille and having an aperture of a diameter slightly larger than that of said plug, said elastomeric body being accommodated in said box, said plug projecting through said aperture and being limited in its pivotable movement by said aperture.

8. A multi-speaker system according to claims 1 or 2, wherein said center pole includes on its distal end an electrically insulating holder supporting a pair of first and second terminals, said external input lead wire being connected to said first and second terminals.

9. A multi-speaker system according to claim 8, wherein said first terminal comprises a jack disposed centrally of said holder, said branch toward said midrange and/or high-frequency loudspeakers including a plug insertable into said jack, said second terminal comprising terminal members fixed to said holder around said jack, said branch toward said low-frequency loudspeaker being connected to said second terminal.

10. A multi-speaker system according to claim 8, wherein said holder has a central hole extending coaxially with and communicating with said through hole in said center pole, said external input lead wire extending through said central hole in said holder.

11. A multi-speaker system according to claim 10, wherein said holder has a lateral hole defined in a side wall thereof and communicating with an outer circumferenctial surface of said holder, said low-frequency loudspeaker including a cone-shaped diaphragm, said dust-tight spider and said cone-shaped diaphragm jointly defining a space communicating with the exterior of the multi-speaker system through said lateral hole.

12. A multi-speaker system according to claims 4, 5, 6 or 7, wherein said midrange and/or high-frequency loudspeaker are supported on said grille with axes along which sound is radiated thereby intersecting that of said low-frequency loudspeaker, said midrange and/or high-frequency loudspeakers having a frame supported on a seat portion of said grille, said terminal assembly being disposed below said seat portion.

* * * * *